US009874843B2

(12) United States Patent
Takayanagi

(10) Patent No.: US 9,874,843 B2
(45) Date of Patent: Jan. 23, 2018

(54) IMAGE FORMING APPARATUS

(71) Applicant: CANON KABUSHIKI KAISHA, Tokyo (JP)

(72) Inventor: Hiroki Takayanagi, Abiko (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 15/170,067

(22) Filed: Jun. 1, 2016

(65) Prior Publication Data

US 2016/0357137 A1 Dec. 8, 2016

(30) Foreign Application Priority Data

Jun. 2, 2015 (JP) ..... 2015-112706

(51) Int. Cl.
*G03G 15/00* (2006.01)

(52) U.S. Cl.
CPC ..... *G03G 15/5041* (2013.01); *G03G 15/5058* (2013.01); *G03G 2215/00042* (2013.01)

(58) Field of Classification Search
CPC ..... G03G 15/5041; G03G 15/5054; G03G 15/5058; G03G 15/5062; G03G 2215/00029; G03G 2215/00033; G03G 2215/00037; G03G 2215/00042
See application file for complete search history.

(56) References Cited

U.S. PATENT DOCUMENTS

| | | | | |
|---|---|---|---|---|
| 7,020,404 B2 * | 3/2006 | Fukuda | G03G 15/5058 | 399/49 |
| 2009/0016762 A1 * | 1/2009 | Ota | G03G 15/5041 | 399/74 |
| 2016/0026145 A1 * | 1/2016 | Park | G03G 21/0005 | 399/98 |

FOREIGN PATENT DOCUMENTS

| | | |
|---|---|---|
| JP | 3659312 B2 | 6/2005 |
| JP | 4724288 B2 | 7/2011 |
| JP | 5781333 B2 | 9/2015 |

* cited by examiner

*Primary Examiner* — Carla Therrien
(74) *Attorney, Agent, or Firm* — Fitzpatrick, Cella, Harper & Scinto

(57) ABSTRACT

An image forming apparatus includes a detecting portion to detect a test toner image formed on an image bearing member, and a shielding member is provided between the detecting portion and the image bearing member and reciprocates between first and second positions. A first opposing portion includes a first member opposed to the image bearing member and provided at a position opposing the image bearing member through an opening in a process of movement of the shielding member, an electrically grounded electroconductive member is disposed in a side opposite a side of the first member opposed to the image bearing member; and a second opposing portion is disposed opposed to the image bearing member and provided at position opposing the image bearing member through the opening in the process of movement of the shielding member from the second position to the first position.

9 Claims, 10 Drawing Sheets

IMAGE FORMING APPARATUS

FIELD OF THE INVENTION AND RELATED ART

The present invention relates to an image forming apparatus such as a copying machine, a printer, a facsimile machine and so on, using an electrophotographic type or electrostatic recording type system.

In a conventional image forming apparatus using the electrophotographic type or electrostatic recording type process, a toner image is formed on an image bearing member which may be a drum-like or belt-like electrophotographic photosensitive member or dielectric member for electrostatic recording, through an image formation process. The toner image is directly transferred onto a recording material fed by a recording material carrying member (direct transfer type), or once transferred onto an intermediary transfer member (primary-transfer) and then transferred onto a recording material (secondary-transfer) (intermediary transfer type). As for the recording material carrying member or the intermediary transfer member, an endless belt is widely used. In a color image forming apparatus, a plurality of image forming stations are arranged along a moving direction of the recording material carrying member or the intermediary transfer member, and multi-color toner images are superimposedly transferred onto the recording material on the recording material carrying member or onto the intermediary transfer member to form a color image.

In such a color image forming apparatus, for example, from the standpoint of the speed-up and image quality improvement, what are important are a coloring stability, a density uniformity, maintenance of the accuracy of toner image registration (suppression of color misregistration) and so on. Therefore, after a toner image for control (controlling image) is formed on a feeding member such as the intermediary transfer member or the recording material carrying member, a reflection density of the image is detected, and the detection result is fed back to image forming process conditions. In the case of the intermediary transfer type image forming apparatus, for example, the controlling image is formed on the intermediary transfer member at the position corresponding to an area between adjacent recording materials in the continuous image formation during a non-image-formation period.

Generally, the sensor for detecting the controlling image comprises a light emitting portion, a light receiving portion and a sensor port (detecting portion) provided between them and the feeding member such as the intermediary transfer member for carrying the controlling image. When the sensor more specifically a surface of the sensor port is contaminated by the toner scattered from the feeding member, a problem of detection error of the controlling image arises.

Under the circumstances, Japanese Patent 4724288 proposes that in order to suppress contamination of the sensor with the toner, the sensor is shielded by a reciprocable plate-like shielding member of metal or resin material during a normal image formation period, for example in which the detection of the controlling image is not carried out. When the controlling image is to be detected, the shielding member is moved to such a position that an opening (hole) provided in said shielding member is opposed to the sensor, thus enabling the detection of the controlling image by the sensor.

However, in the case that the above-described shielding member is used, the toner having entered through the opening during the image forming operation or the like may contaminate the sensor.

During the normal image formation period, the sensor is shielded by the shielding member from the feeding member, but the members in the neighborhood of the sensor opposed to the opening of the shielding member is not shielded. Therefore, the members in the neighborhood of the sensor may be contemplated with the toner during the normal image forming operation period, and the contamination toner may move to contaminate the sensor.

It would be considered to provide an opening opposed to the sensor and an openable member for opening and closing the opening in order to open the opening only during the detection of the controlling image. In such a case, the member in the neighborhood of the sensor is not contaminated with the toner during the normal image forming operation. However, in such a case, the structure is complicated as compared with the plate-like shielding member.

SUMMARY OF THE INVENTION

According to an aspect of the present invention, there is provided an image forming apparatus, comprising a movable image bearing member; an image forming unit configured to form a test toner image on an outer peripheral surface of said image bearing member; a sensor provided opposed to the outer peripheral surface of said image bearing member, said sensor including a detecting portion configured to detect the test toner image formed on said image bearing member; a changing portion configured to change an image forming condition of said image forming unit on the basis of a detection result of said detecting portion; a shielding member having an opening and provided between said detecting portion and said image bearing member, said shielding member being reciprocable between a first position and a second position, wherein when said shielding member is in the first position, said detecting portion is exposed to said image bearing member at a position where said opening is opposed to said detecting portion, and when said shielding member is in the second position, said shielding member shields said detecting portion from said image bearing member; and an opposing portion of porous resin material or rubber provided at a position opposing said image bearing member through said opening at least when said shielding member is in an upstream position with respect to a moving direction of said shielding member from the second position toward the first position, in a process of movement of said shielding member from the second position to the first position.

According to another aspect of the present invention, there is provided an image forming apparatus, comprising a movable image bearing member; an image forming unit configured to form a test toner image on said image bearing member; a sensor provided opposed to said image bearing member and including a detecting portion configured to detect a test toner image formed on said image bearing member; a changing portion configured to change an image forming condition of said image forming unit on the basis of a detection result of said detecting portion; a shielding member having an opening and provided between said detecting portion and said image bearing member, said shielding member being reciprocable between a first position and a second position, wherein when said shielding member is in the first position, said detecting portion is exposed to said image bearing member at a position where said opening is opposed to said detecting portion, and when said shielding member is in the second position, said shielding member shields said detecting portion from said image bearing member; and first and second opposing portions provided at positions opposing said image bearing member through said opening in a process of movement of said shielding member from the second position to the first position, said first opposing portion being disposed at the position upstream of said second opposing portion with respect to a direction of the movement of said shielding member from the second position to the first position, and said second opposing portion has an electrostatic capacity larger than that of said first opposing portion.

Further features of the present invention will become apparent from the following description of exemplary embodiments with reference to the attached drawings.

DESCRIPTION OF THE EMBODIMENTS

A sensor unit and an image forming apparatus according to the present invention will be described in conjunction with the accompanying drawings.

[Embodiment 1]

1. General Arrangement and Operation of Image Forming Apparatus

Figure 1:
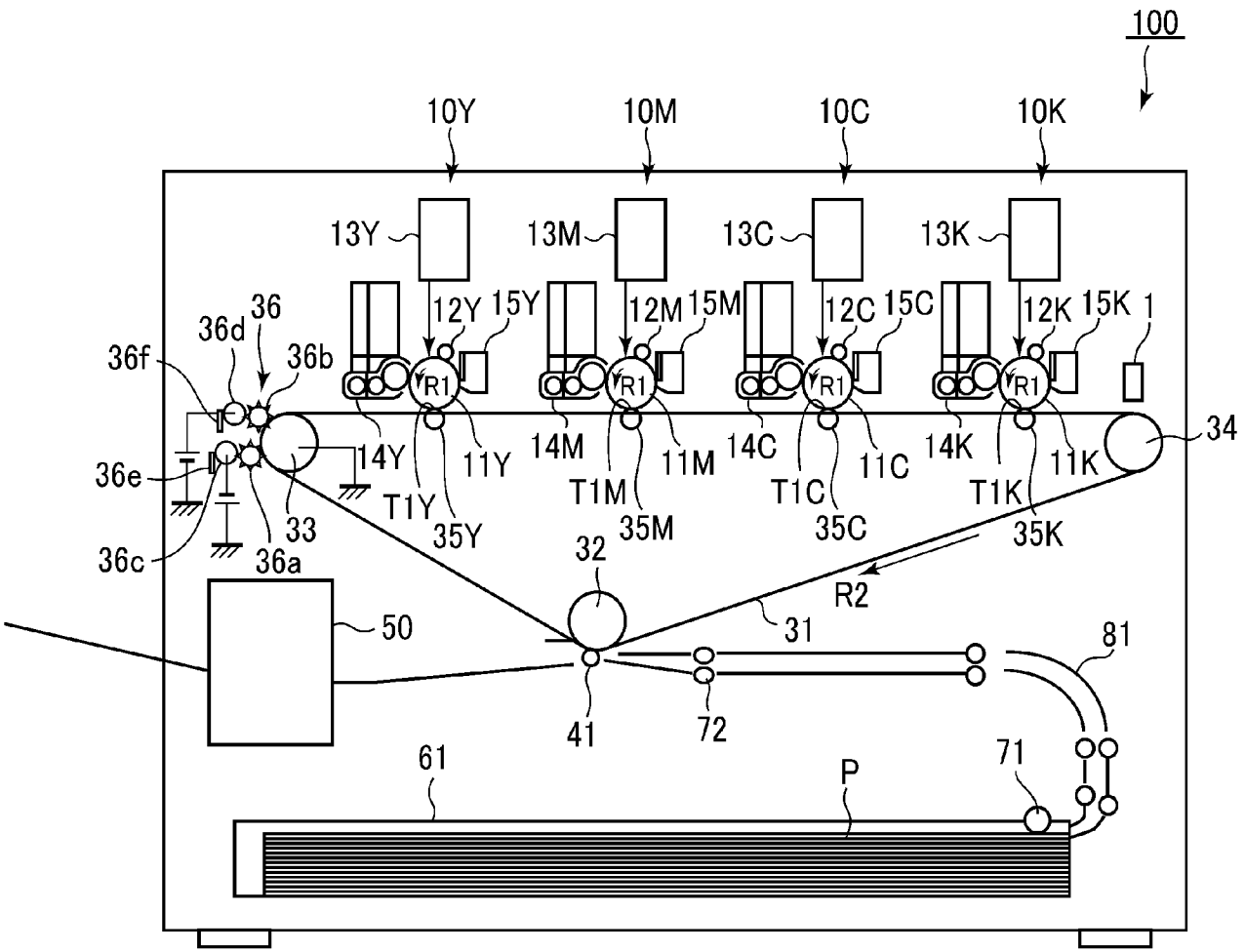
FIG. 1 is a schematic sectional view of an image forming apparatus.

FIG. 1 is a schematic section of view of an image forming apparatus 100 according to an embodiment of the present invention. The image forming apparatus 100 is a tandem color image forming apparatus of an intermediary transfer type.

The image forming apparatus 100 comprises first, second, third and fourth image forming stations 10Y, 10M, 10C, 10K as a plurality of image forming stations. The image forming stations 10Y, 10M, 10C, 10K are arranged in a line along a horizontal direction in which the intermediary transfer belt 31 extends and are capable of forming yellow (Y), magenta (M), cyan (C) and black (K) images, respectively.

The structures and operations of image forming stations 10Y, 10M, 10C, 10K are substantially the same, except for the colors of the toner used in the developing process. Therefore, in the following description, the description without the suffixes Y, M, C and K applies commonly to them.

The image forming station 10 comprises a photosensitive drum 11 as an image bearing member which is a rotatable drum type electrophotographic photosensitive member (photosensitive member). The photosensitive drum 11 is rotatable in a direction indicated by an arrow R1 in the Figure. The image forming station 10 further comprises process means arranged along the circumference of the photosensitive drum 11. First, a charging roller 12 as charging means is provided and is a roller type charging member. Next, an exposure device (laser scanner) 13 is provided as exposure means. Then, a developing device 14 is provided as a developing means. Then, a primary transfer roller 35 as primary transferring means is provided and is a roller type primary transfer member. Further, a drum cleaning device 15 is provided as photosensitive member cleaning means. The developing devices 14Y, 14M, 14C and 14K contain yellow, magenta, cyan and black toner particles.

The image forming apparatus 100 comprises an intermediary transfer belt 31 as an intermediary transfer member in the form of an endless belt, and the intermediary transfer belt 31 is disposed opposed to the photosensitive drums 11Y, 11M, 11C and 11K. The intermediary transfer belt 31 is stretched around a plurality of stretching rollers including a driving roller 33, tension roller 34 and a back-up roller (secondary transfer opposing roller) 32 and is rotatable in the direction indicated by a arrow R2. The primary transfer rollers 35 are disposed opposed to the respective photosensitive drums 11Y, 11M, 11C and 11K inside the endless intermediary transfer belt 31. In the primary transfer roller 35 is urged toward the photosensitive drum 11 with the intermediary transfer belt 31 therebetween, and forms a primary transfer portion T1 where the photosensitive drum 11 and the intermediary transfer belt 31 contact to each other. In the outside of the endless intermediary transfer belt 31, a secondary transfer roller 41 which is a roller type secondary transfer member as secondary transferring means is provided at a position opposed to the back-up roller 32. The secondary transfer roller 41 is urged toward the back-up roller 32 with the intermediary transfer belt 31 therebetween to form a secondary transfer portion T2 where the intermediary transfer belt 31 and the secondary transfer roller 41 contact to each other. In the outside of the intermediary transfer belt 31, a belt cleaning device 36 as intermediary transfer member cleaning means is provided at a position opposed to the driving roller 33. The intermediary transfer belt 31 is an example of the movable feeding member for carrying a controlling image of toner. In this embodiment, the image forming stations 10Y, 10M, 10C and 10K are forming means for forming the controlling images on the intermediary transfer belt 31 as the feeding member.

During the image forming operation, the surface of the rotating photosensitive drum 11 is uniformly charged by the charging roller 12. The charged surface of the photosensitive drum 11 is exposed to the laser beam supplied from an exposure device 13 and modulated in accordance with image information, by which the electrostatic latent image (electrostatic image) is formed in accordance with image information. The exposure device 13 projects a laser beam from a laser source in accordance with the image signal of the color component corresponding to the associated image forming station 10 to the surface of the photosensitive drum 11 by way of a polygonal mirror, so that an electrostatic latent image is formed on the photosensitive drum 11. The electrostatic latent image formed on the photosensitive drum 11 is developed by the developing device 14 with the toner into a toner image. In this embodiment, the developing device 14 develops the toner image through a reverse development type process. That is, on the exposed portion of the photosensitive drum 11 where the absolute value of the potential is decreased by the exposure to the laser beam after the uniform charging, the toner charged to the same polarity as the charge polarity of the photosensitive drum 11 (negative in this embodiment) is deposited. The toner image formed on the photosensitive drum 11 is electrostatically transferred (primary-transfer) onto the intermediary transfer belt 31 by the function of the primary transfer roller 35 in the primary transfer portion T1. At this time, the primary transfer roller 35 is supplied with a primary transfer bias which is a DC voltage of a polarity opposite to the charge polarity (regular charge polarity) of the toner in the developing operation. The toner remaining on the photosensitive drum 11 after the primary transfer step (primary-untransferred toner) is removed and collected from the surface of the photosensitive drum 11 by the drum cleaning device 15. In the case of the full-color image formation, for example, the toner images of the respective colors formed on the photosensitive drums 11Y, 11M, 11C, 11K through the process described above are superimposedly transferred onto the intermediary transfer belt 31 (primary-transfer).

And then, a recording material (transfer material, recording material) S stored in the recording material cassette 61 is supplied into the recording material feeding path 81 by rotation of a recording material supplying roller 71. Then, registration rollers 72 feed the recording material S into the secondary transfer portion T2 in timed relationship with the toner image on the intermediary transfer belt 31. In the secondary transfer portion T2, the toner image is it electrostatically transferred from the intermediary transfer belt 31 onto the recording material S (secondary-transfer) by the secondary transfer roller 41. At this time, the secondary transfer roller 41 is supplied with a secondary transfer bias voltage which is a DC voltage of the polarity opposite to the regular charge polarity of the toner. The toner remaining on the intermediary transfer belt 31 after the secondary transfer step (secondary-untransferred toner) is removed from the surface of the intermediary transfer belt 31 by the belt cleaning device 36 as the intermediary transfer member cleaning means.

The recording material S having the transferred is fed into a heat fixing device 50. The heat fixing device 50 applies heat and pressure to the recording material S to fix the toner image on the surface of the recording material S into a full-color image print. Thereafter, the recording material S is fed out of the main assembly of the image forming apparatus 100.

The image forming apparatus 100 further comprises a sensor unit 1 for detecting the controlling image (toner image) carried on the intermediary transfer belt 31. In this embodiment, the controlling image includes a patch for image density control, a patch for toner supply control and a patch for color misregistration (registration) correction control, which are formed on the intermediary transfer belt 31. The sensor unit 1 includes a plurality of sensors 2 each comprising a reflection type optical sensor. In this embodiment, the sensor unit 1 is disposed downstream of the downstreammost primary transfer portion T1K and upstream of the secondary transfer portion T2 with respect to the rotational direction of the intermediary transfer belt 31, more particularly, at a position opposed to the tension roller 34. The details of the controlling image and the sensor unit 1 will be described in detail hereinafter.

In this embodiment, the intermediary transfer belt 31 as a circumferential length of 1100-2400 mm and is rotated at a peripheral speed (feeding speed) of 90-480 mm/sec, for example. More particularly, in this embodiment, the circumferential length of the intermediary transfer belt 31 is 2230 mm, and the peripheral speed is 470 mm/sec.

In this embodiment, the intermediary transfer belt 31 is an elastic belt. The intermediary transfer belt 31 comprises a base layer (back side layer), an elastic layer (middle layer) and a surface layer. The base layer comprises a resin material of polyimide, polycarbonate or the like or rubber material, and a proper amount of carbon black as a charging prohibiting material, and it has a thickness of 0.05-0.2 mm. The elastic layer comprises CR, urethane rubber or the like rubber and carbon black as a charging prohibiting material, and it has a thickness of 0.1-0.3 mm. The surface layer comprises resin material such as urethane resin material, fluorinated resin material or the like raising material, and it has a thickness of 0.001-0.020 mm. The materials of the intermediary transfer belt 31 are not limited to the above-described examples.

In addition, in this embodiment, the belt cleaning device 36 includes a first furbrush 36*a* provided at an upstream position and a second furbrush 36*b* disposed at a downstream position with respect to the rotational direction of the intermediary transfer belt 31. The first and second furbrushes 36*a* and 36*b* each comprises a metal roller and electroconductive fibers planted on the metal roller. To the first and second furbrushes 36*a*, 36*b*, first and second metal rollers 36*c*, 36*d* are contacted, respectively. To the first and second metal rollers 36*c*, 36*d*, the first and second cleaning blades 36*e*, 36*f* are contacted, respectively. To the first metal roller 36*c*, a DC voltage of negative is applied from the DC voltage source. By this, the positive toner is deposited on the first furbrush 36*a* from the surface of the intermediary transfer belt 31 and is transferred onto the first metal roller 36*c*, and then is scraped off and collected by the first cleaning blade 36*e*. To the second metal roller 36*d*, a DC voltage of the positive is applied from the DC voltage source. By this, the toner of the negative on the intermediary transfer belt 31 is deposited on the second furbrush 36*b* and is transferred onto the second metal roller 36*d*, and then is scraped off and collected by the second cleaning blade 36*f*.

2. Image Control

In this embodiment, the controlling images (image density control patch, toner supply control patch, color misregistration correction control registration patch) are formed on the intermediary transfer belt 31. The controlling images are protected by the sensors 2 of the sensor unit 1. In this embodiment, the sensors 2 for detecting the image density control patch, the toner supply control patch and the color misregistration correction control have the similar structures.

Figure 2:
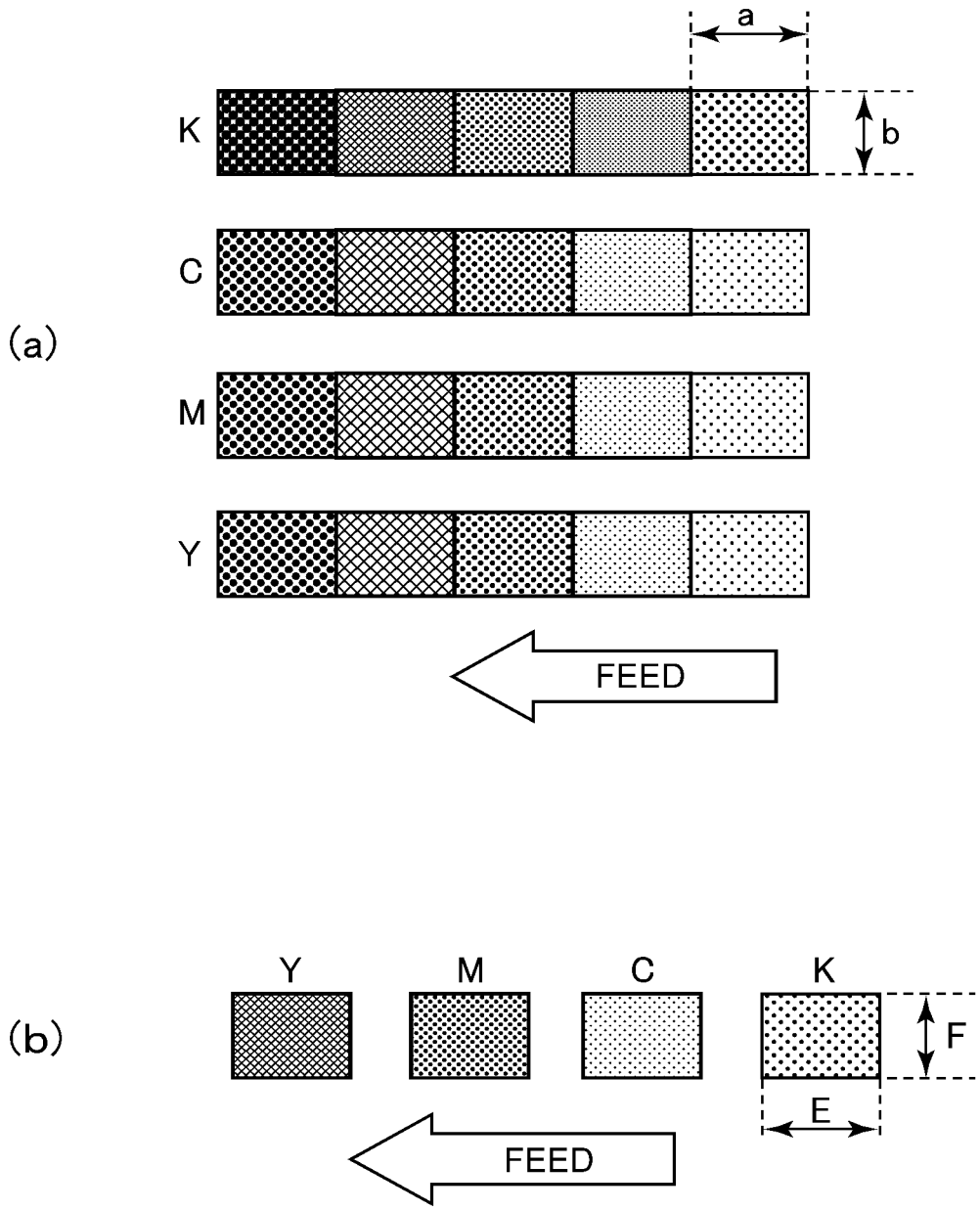
FIG. 2 is a schematic view of a controlling image.

As shown in part (a) of FIG. 2, the image density control patch includes five contiguously arranged units patches each having a length of 15-40 mm as measured in the feeding direction, and a length b 10-30 mm as measured in a main scan direction which is substantially perpendicular to the feeding direction. Reflection densities of the unit patches (measured by a reflection density meter a rotatable from XRite) are 0.2±0.1, 0.5±0.1, 0.8±0.1, 1.1±0.1, 1.4±0.1, as from the upstream side in the feeding direction. The reflection densities are the densities when the image density control patch is printed on the sheet, but in the actual control operation, the image density control patch is not transferred (secondary-transfer) onto a sheet and is removed by the belt cleaning device 36. The image density control patches for the Y, M, C, K colors are juxtaposed along the main scan direction. In this embodiment, the length a in the feeding direction is 23±1 mm, and the length b in the main scan direction is 16±1 mm. The image density control patch is detected by the sensor 2 of the sensor unit 1, and the condition for the formation of the electrostatic latent image is controlled so that the image densities are 0.2, 0.5, 0.8, 1.1, 1.4.

As shown in part (b) of FIG. 2, the toner supply control patch includes Y, M, C, K patches each including one unit patch and each having a length E of 15-40 mm as measured in the feeding direction, and a length F of 10-30 mm as measured in the main scan direction. The reflection densities (measured by reflection density meter available from XRite) of the unit patches are 0.8±0.1. The reflection densities are the densities when the toner supply control patch is printed on the sheet, but in the actual control operation, the toner supply control patch is not transferred (secondary-transfer) onto a sheet and is removed by the belt cleaning device 36. In this embodiment, the length E measured in the feeding direction is 23±1 mm, and the length F measured in the main scan direction is 16±1 mm. The toner supply control patch is detected by the sensor 2 of the sensor unit 1, and the toner supply into the developing device 14 is controlled in accordance with the detection result. In this embodiment, the toner supply control patches are arranged in a line in the feeding direction, but they may be arranged in the main scan direction.

Figure 3:
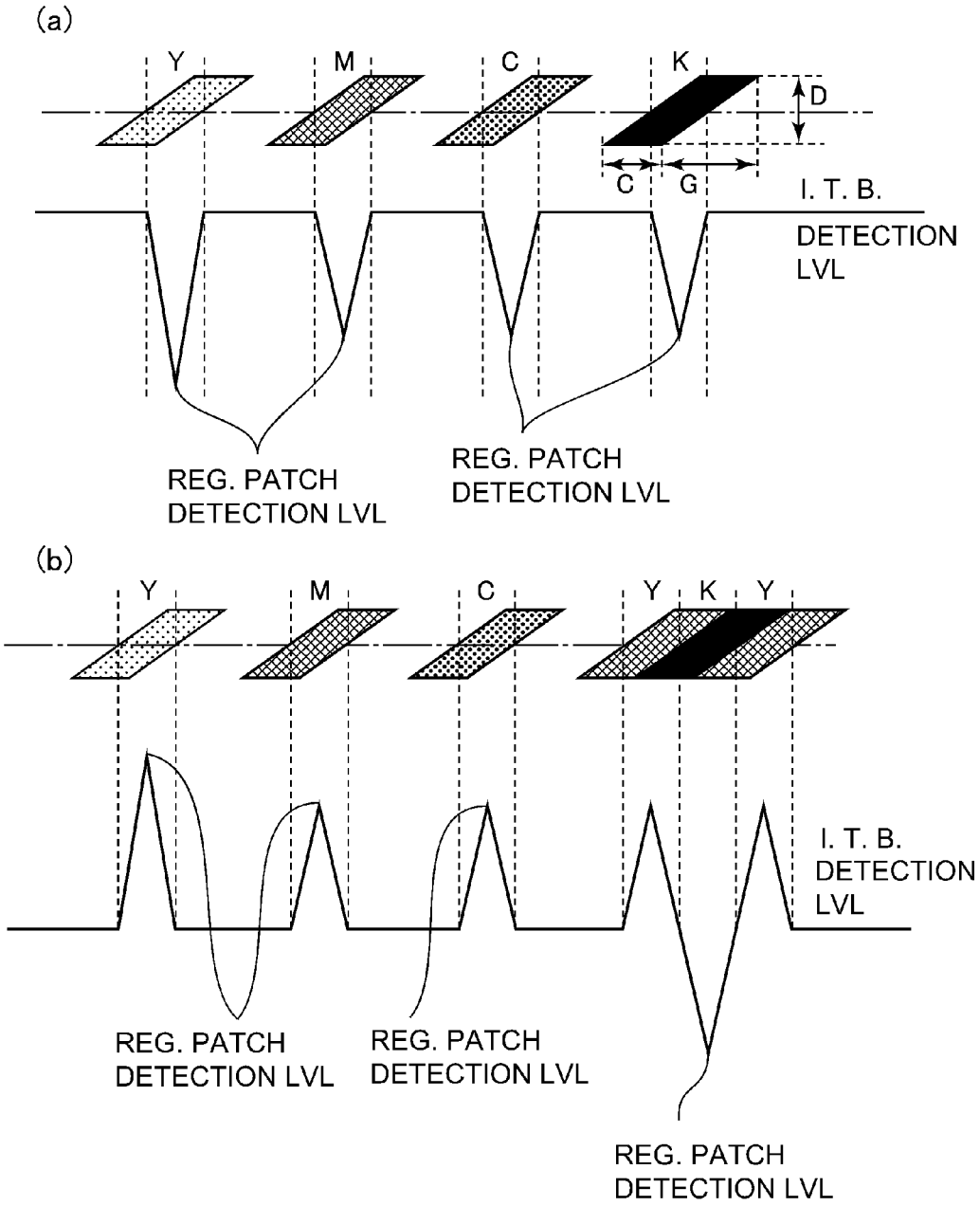
FIG. 3 is a schematic view of a controlling image.

As shown in part (a) of FIG. 3, the color misregistration correction control patch for each of Y, M, C, K colors includes one parallelogram unit patch, and these unit patches of contiguously arranged in the feeding direction. Each parallelogram unit patch as a length C of 1-3 mm as measured in the feeding direction, a height D of 3-8 mm in the main scan direction, and a height G of 4-5 mm in an inclined direction. The reflection densities (measured by reflection density meter available from XRite) of the unit patches are 1.4±0.1. The reflection densities are the densities when the color misregistration correction control patch is printed on the sheet, but in the actual control operation, the color misregistration correction control patch is not transferred (secondary-transfer) onto a sheet and is removed by the belt cleaning device 36. Part (a) of FIG. 3 shows a detected waveform when the used sensor 2 is a specular reflection sensor. A deviation amount is detected between a gravity center position of each of Y, C, K color unit patches and a gravity center position of the unit patch of M color which is the reference color. The image writing timing at the time when the electrostatic latent image is formed by the exposure device 13 is changed so as to correct the deviation. Part (b) of FIG. 3 shows the configurations of the color misregistration correction control patches in the case that the used sensor 2 is a diffused reflection sensor and the detected waveforms thereof from. Also in this case, a deviation amount is detected between a gravity center position of each of Y, C, K color unit patches and a gravity center position of the unit patch of M color which is the reference color. The image writing timing at the time when the electrostatic latent image is formed by the exposure device 13 is changed so as to correct the deviation. The configuration of the color misregistration correction control patch is not limited to the above-described configuration.

The controlling images are formed on the intermediary transfer belt 31 through a normal image forming process including the formation of the electrostatic latent image (electrostatic latent image of the controlling image), the development and the primary-transfer.

Figure 4:
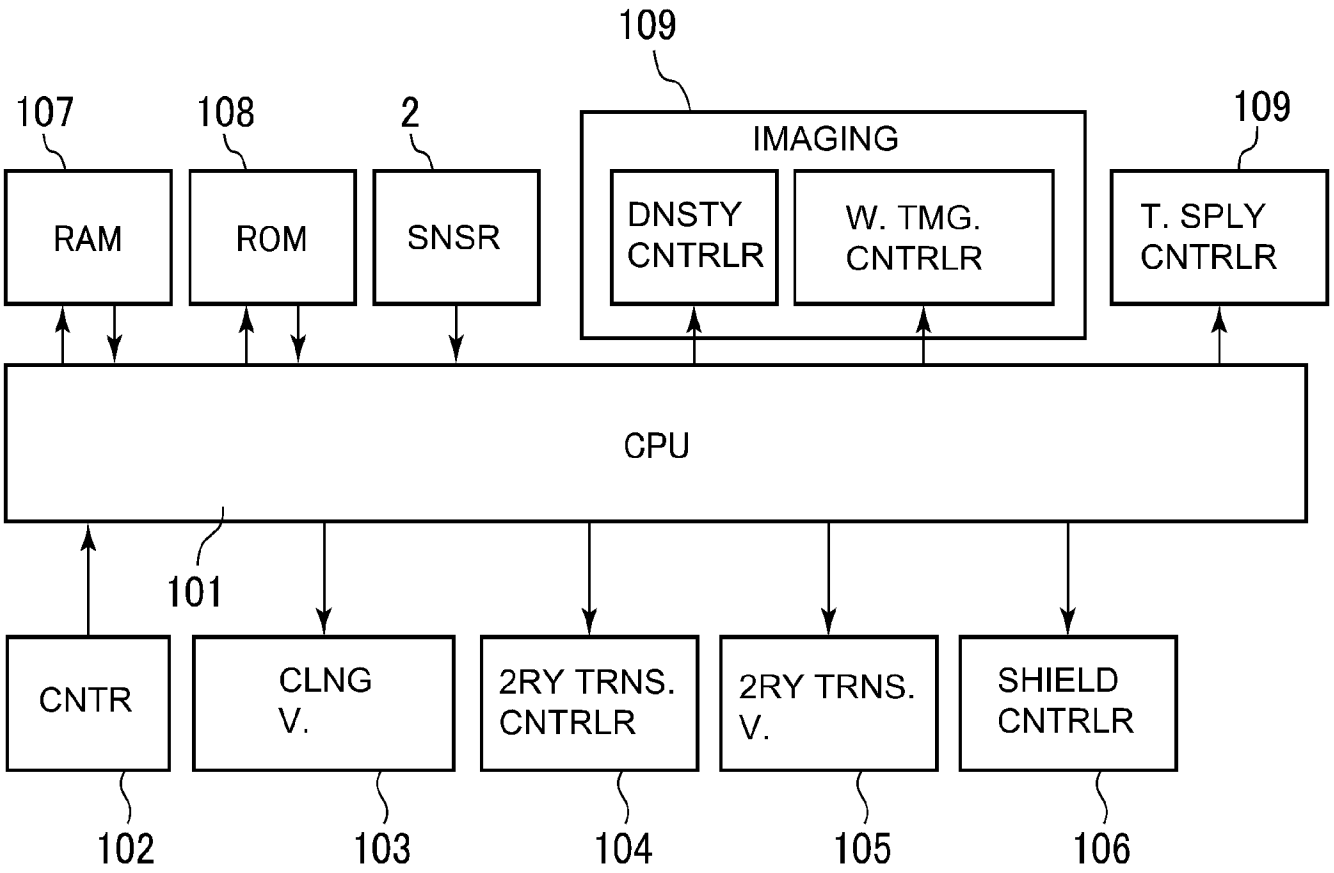
FIG. 4 is a block diagram of a control manner in the image forming apparatus.

FIG. 4 is a block diagram illustrating a schematic control manner in the image forming apparatus 100 according to this embodiment. The operation of each part of the image forming apparatus 100 is overall controlled by the CPU101 as the controlling means. The program for the control of the CPU101 is stored in the ROM 108 as the storing means. When the image forming operation starts, a sheet counter 102 feeds the number of image formations to the CPU101. That when the number of image formations exceeds a predetermined threshold, the controlling images are formed. The number of image formations is counted differently depending on the sizes of the recording materials P, more particularly, it is incremented by one for small size sheet (A4, A5, LTR or the like) in the incremented by two for large size sheet (A3, SRA3, 13×19 inch or the like). In this embodiment, when the count detected by the counter 102 reaches 2000, the CPU101 instructs formation of the controlling images by the image output portion 109. The sensors 2 of the sensor unit 1 is disposed at such a position that is capable of reading the controlling image on the outer periphery side of the intermediary transfer belt 31. In this embodiment, the sensor unit 1 includes four sensors 2 arranged in the widthwise direction of the intermediary transfer belt 31 (the direction substantially perpendicular to the moving direction of the surface of the intermediary transfer belt 31. Each sensor 2 is a reflection type sensor and comprises a light emitting portion and a light receiving portion. The sensor 2 projects light to the controlling image formed with the toner on the intermediary transfer belt 31, and detects the reflected light. The CPU101 receives the detection signal of the sensor 2, and the detection signal is supplied to the RAM 107 as the storing means, which stores the detection signal. On the basis of the detection signal of the sensor 2, the CPU101 instructs an image density control portion and a writing out timing control portion of the image output portion 109 to execute the image density control for providing appropriate image density and the color misregistration correction control for providing appropriate electrostatic latent image writing out start timing. In addition, the CPU101 instructs, on the basis of the detection signal of the sensor 2, the toner supply control portion to execute the toner supply control for supplying the proper amount of the toner at proper timing.

The formation of the controlling images of the plurality of kinds (toner supply control patch, image density control patch and color misregistration correction control patch) is not limited to the continuous formation in one non-image portion area. For example, they may be formed in different non-image portions such as different sheet intervals.

After the controlling images on the intermediary transfer belt 31 are detected by the sensor 2 and before the controlling image passes the secondary transfer portion T2, the secondary transfer roller 41 is spaced from the intermediary transfer belt 31. At this time, the CPU101 instructs the mounting and demounting operation control portion 104 for the secondary transfer portion to space the secondary transfer roller 41 from the intermediary transfer belt 31. Therefore, the controlling image is not contacted by the secondary transfer roller 41 but is directly fed to the belt cleaning device 36. However, the time is not enough to carry out the spacing operation, a transferring electric field is formed in the direction opposite to that in normal secondary-transfer operation in the secondary transfer portion T2, thus preventing the transfer of the controlling image toner onto the secondary transfer roller 41, so that the controlling image toner is fed to the belt cleaning device 36. In such a case, the CPU101 instructs a secondary transfer portion voltage output portion 105 to apply the voltage of the opposite polarity to the secondary transfer roller 41 before the controlling image reaches the secondary transfer portion T2. The CPU101 instructs a cleaning voltage output portion 103 to apply voltages to the first second metal rollers 36*c*, 36*d*, in timed relation ship with the arrival of the controlling image toner at the belt cleaning device 36.

3. Sensor Unit

Figure 5:
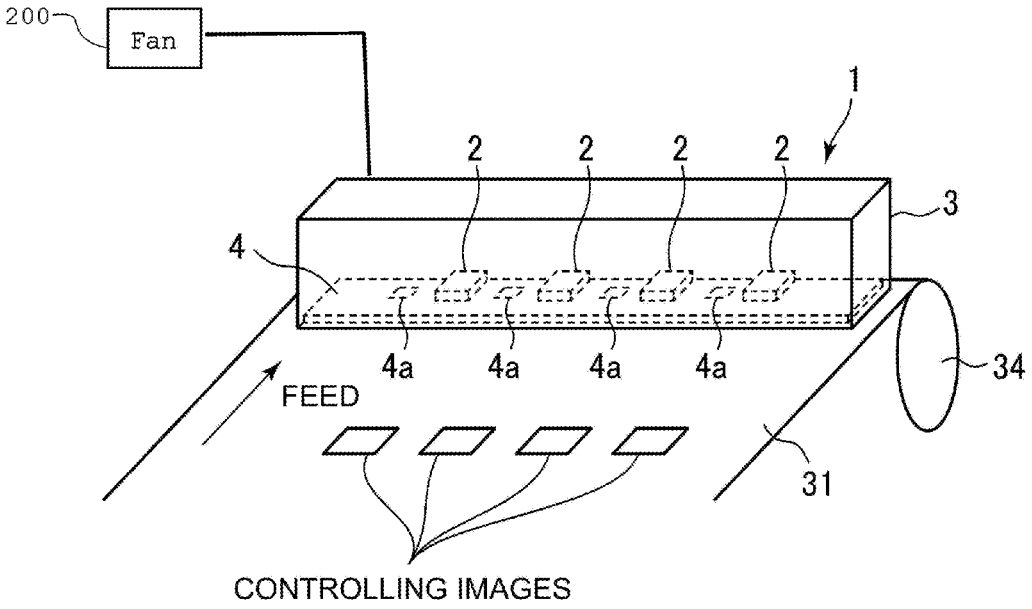
FIG. 5 is a schematic perspective view of a sensor unit.

The sensor unit 1 will be described in detail. FIG. 5 is a schematic perspective view of a sensor unit. The sensor unit 1 is disposed opposed to the intermediary transfer belt 31 carrying the controlling images. The sensor unit 1 comprises four sensors 2, a sensor holder (casing) 3 as the supporting member, and a shielding member 4 for exposing and shielding the sensors 2 relative to the intermediary transfer belt 31.

The sensor holder 3 is elongated in a direction crossing with (substantially perpendicular to, in this embodiment) the moving direction (feeding direction) of the surface of the intermediary transfer belt 31, and is provided with a substantially rectangular opening on the bottom side facing the intermediary transfer belt 31.

The four sensors 2 are arranged in a line in the longitudinal direction of the sensor holder 1, that is, in the direction crossing with (substantially perpendicular to, in this embodiment) the feeding direction of the intermediary transfer belt 31. The sensors 2 are supported by the sensor holder 1 such that the sensor ports (FIG. 8) as the detecting portion are exposed to the intermediary transfer belt 31 at the bottom portion of the sensor holder 1. Each sensor 2 is a reflection type optical sensor in the form of a unit including the light emitting portion 2*b* (FIG. 8), the light receiving portion 2*c* (FIG. 8) and a signal processing circuit (unshown). That is, in this embodiment, the sensor 2 is effective to detect the controlling image formed with the toner and carried on the feeding member 31, and is provided with a detecting portion 2*a* opposed to the feeding member 31. In this embodiment, the structures of the parts to which the openings of the shielding member 4 which will be described hereinafter are substantially the same, and only one of the sensors 2 will be described, for the sake of simplicity.

Figure 6:
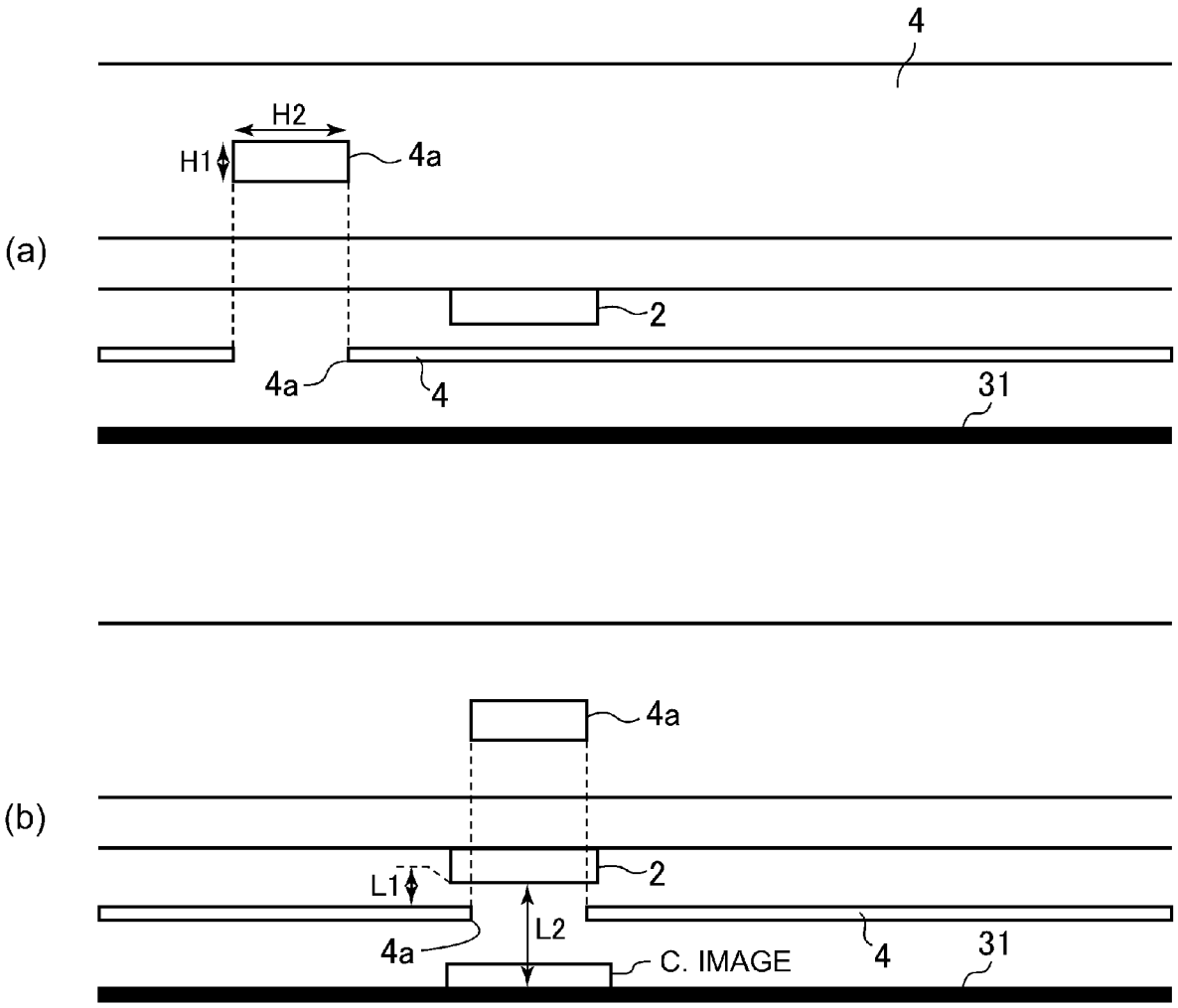
FIG. 6 is a schematic bottom view and a side view of a section of the structure adjacent the sensor.

Part (a) and (b) of FIG. 6 are a schematic bottom view (upper side) and sectional side view (lower side) of the neighborhood of the sensor 2. In the shielding member 4 is a substantially rectangular plate-like member elongated in the direction crossing with (perpendicular to, in this embodiment) to the feeding direction of the intermediary transfer belt 31, and is provided with four through openings (holes) 4*a* at the positions corresponding to the respective sensors 2. The shielding member 4 is supported by the sensor holder 3 so as to substantially enclose the bottom portion of the sensor holder 3, the shielding member 4 being reciprocable in the longitudinal direction of the sensor holder 3. In this embodiment, the shielding member 4 is a metal plate having a thickness of 0.5-2 mm or resin material of POM, PE or the like having a thickness of 2-3 mm. In this embodiment, the opening 4*a* has a length H1 of 5-7 mm as measured in the moving direction of the shielding member 4, and a length H2 of 12.5-13.5 mm as measured in the direction substantially perpendicular to the moving direction of the shielding member 4.

As shown in part (a) of FIG. 6, when the detection of the controlling image by the sensors 2 is not carried out, the shielding member 4 is in the second position where the openings 4*a* are not faced to the sensors 2, and the sensors 2 are shielded from the intermediary transfer belt 31. By doing so, the contamination of the sensors 2 with the toner on the intermediary transfer belt 31 can be suppressed in the normal image forming operation.

On the other hand, as shown in part (b) of FIG. 6, when the detection of the controlling images by the sensors 2 is to be carried out, the shielding member 4 is moved from the second position rightwardly along the direction substantially perpendicular to the feeding direction of the intermediary transfer belt 31 to a first position where the openings 4*a* are faced to the respective sensors 2. More particularly, at this time, the opening 4*a* opens the optical path of the sensor 2 to permit the direction of the controlling images by the sensors 2 by exposing the sensors 2 through at least a part of the sensor ports. By this, the sensors 2 are enabled to detect the controlling images on the intermediary transfer belt 31 through the openings 4*a*.

When the detection of the controlling images by the sensors 2 is completed, the shielding member 4 is returned to the second position (part (a) of FIG. 6) from the first position (part (b) of FIG. 6).

In this manner, the shielding member 4 is provided with openings 4*a* between the detecting portions 2*a* of the sensors 2 and the feeding member 31. The shielding member 4 is reciprocable (translational movement) between the first position in which the openings 4*a* are faced to the detecting portions 2*a* to enable the detection of the controlling image by the sensor 2 and the second position in which the openings 4*a* are not faced to the detecting portion 2*a* to shield the detecting portion 2*a* from the feeding member 31.

As shown in FIG. 4, the movement of the shielding member 4 (opening and closing) is carried out by a shielding member opening and closing operation control portion 106 in accordance with the instructions from the CPU101 at the timing of the necessity for the detection of the controlling images. The shielding member opening and closing operation control portion 106 includes a motor or solenoid as the driving source, and a drive transmitting portion for transmitting the driving force to the shielding member in accordance with the instructions from the CPU101.

As shown in part (b) of FIG. 6, in this embodiment, a distance L1 from the surface of the shielding member 4 to the sensor 2 is 1.5-2.5 mm. In this embodiment, the distance L2 from the surface of the intermediary transfer belt 31 to the sensor 2 is 5.5-6.5 mm.

When the shielding member 4 is in the first position, the air may be flown toward the intermediary transfer belt 31 through the opening 4*a* from the surface of the sensor port of the sensor 2. This can be accomplished by feeding the air from the outside into the inside of the substantially box-like sensor holder 3 using a fan 200 (FIG. 5) and discharging the air through the openings 4*a* of the shielding member 4. In this case, the sensor holder 3 contains the sensors 2, and the shielding member 4 is disposed opposed to the intermediary transfer belt 31, and the air pressure is higher (positive pressure) inside the sensor holder 3 than outside the sensor holder 3. In this manner, the toner is prevented from moving toward the sensor 2 through the opening 4*a* from the surface of the intermediary transfer belt 31.

Figure 7:
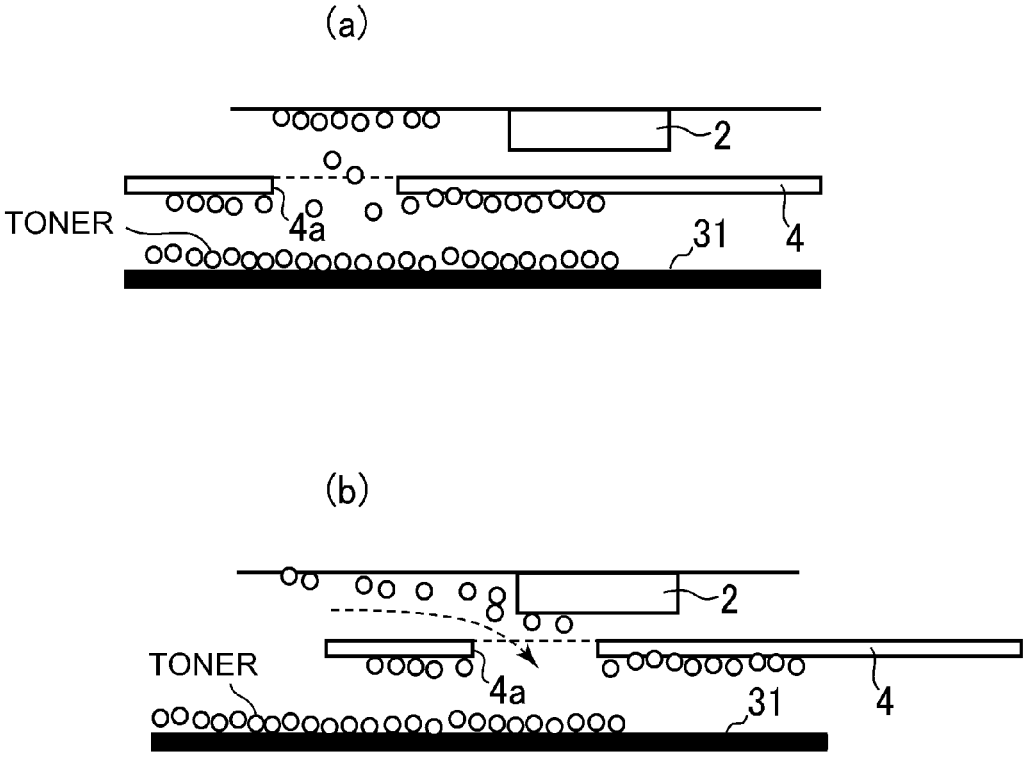
FIG. 7 is a schematic sectional view illustrating a mechanism causing contamination of the sensor with toner.

The mechanism of contamination, with the toner, of the sensors 2 of the sensor unit 1 having the above-described structures will be described. FIG. 7 is a schematic sectional side view of the neighborhood of the sensor 2 to illustrate the path of the contaminating toner.

As shown in part (a) of FIG. 7, when the shielding member 4 is in the second position, the toner charged to the negative polarity on the intermediary transfer belt 31 floats toward a low potential member. Most of the floating toner is deposited on the shielding member 4, but the rest passes through the opening 4*a* of the shielding member 4 and is deposited on the member adjacent to the sensor 2. Then, the potential of the member in the-neighborhood of the sensor 2 where the toner is deposited becomes high, and therefore, the toner is moved toward the position closer to the sensor 2 when the potential this lower. Then, as shown in part (b) of FIG. 7, the toner may finally contaminate the sensor 2 itself.

As shown in part (b) of FIG. 7, if the air flows from the sensor 2 toward the intermediary transfer belt 31 through the opening 4*a* when at least a part of the opening 4*a* is faced to the sensor 2, the contamination of the sensor 2 with the toner may be enhanced. That is, as indicated by the broken line in part (b) of FIG. 7, the flow of the air toward the opening 4*a* at this time is in the direction from the position where the toner is deposited adjacent to the sensor 2 toward the sensor 2. Therefore, when at least a part of the opening 4*a* is opposed to the sensor 2, that is, when the shielding member 4 is in the first position, or during the movement of the shielding member 4 from the second position to the first position, the toner deposited on the neighborhood of the sensor 2 is further enhanced to move toward the sensor 2.

In view of this, in this embodiment, an adjacent portion of the sensor 2 faced to the opening 4*a* in the process of the movement of the shielding member 4 from the second position to the first position has the following structure. It comprises an upstream side first adjacent portion and a downstream side second adjacent portion with respect to the moving direction of the shielding member 4 from the first position from the second position to the first position. An electrostatic capacity of the second adjacent portion is smaller than that of the first adjacent portion. By doing so, the movement of the toner deposited on the neighborhood of the sensor 2 described above can be suppressed. The description will be made in more detail.

Figure 8:
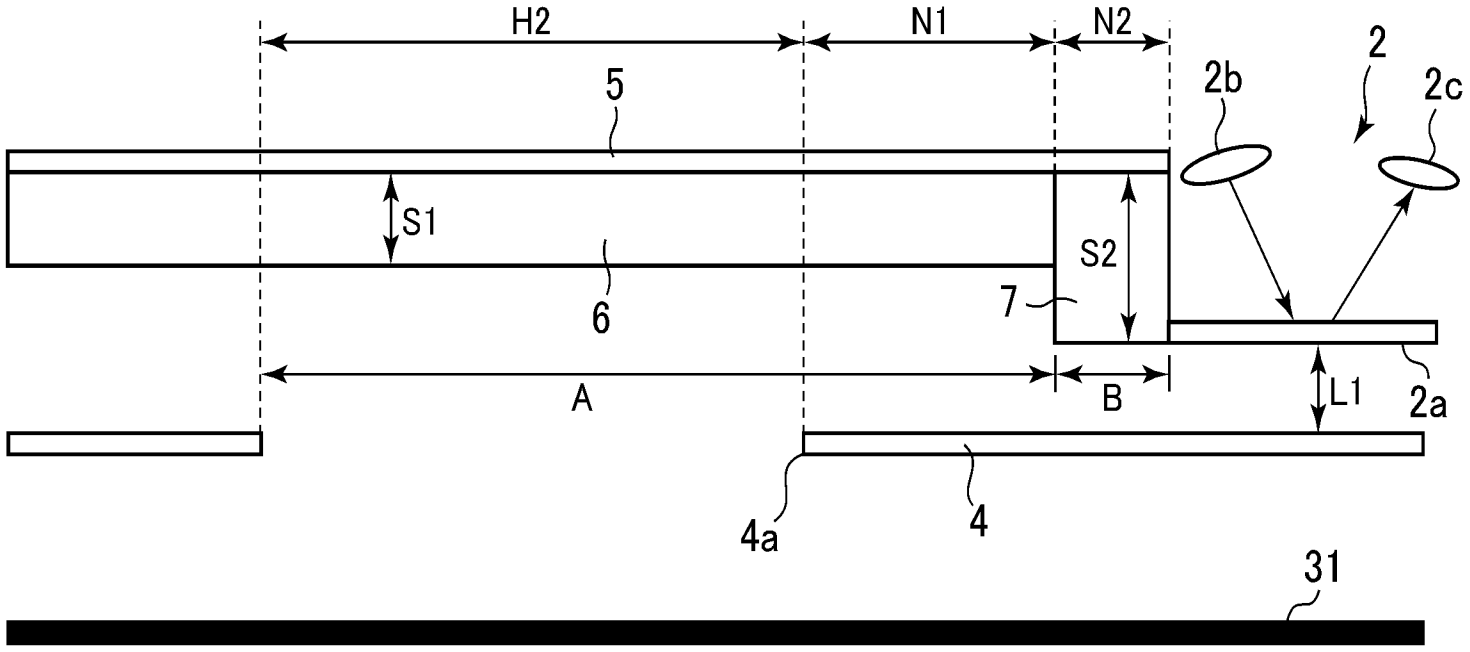
FIG. 8 is a schematic section of view illustrating a structure adjacent to the sensor in Embodiment 1 of the present invention.

FIG. 8 is a schematic sectional side view showing the details of the structures in the neighborhood of the sensor 2. In this embodiment, the parts adjacent to the sensor 2 faced to the opening 4*a* in the process of the movement of the shielding member 4 from the second position toward the first position are constituted as follows. The member adjacent to the sensor 2 comprises an electroconductive member 5 of electroconductive material electrically grounded, and a first toner deposition member 6 and a second toner deposition member 7 of a dielectric material or an insulative material. The first toner deposition member 6 is placed in an upstream side, and the second toner deposition member 7 is placed in the downstream side with respect to the moving direction of the shielding member 4 from the second position toward the first position. The electroconductive member 5 contacts the surfaces of the first toner deposition member 6 and the second toner deposition member 7 on the sides opposite to the side (toner deposition surface) opposing to the intermediary transfer belt 31. The first adjacent portion A is constituted by the electroconductive member 5 and the first toner deposition member 6, and the second adjacent portion B is constituted by the electroconductive member 5 and the second toner deposition member 7.

Typically, a volume resistivity of the electroconductive member is not more than 1×10^9 Ωcm, and a volume resistivity of the dielectric member is not less than 1×10^10 Ωcm and not more than 1×10^13 Ωcm, and a volume resistivity of the insulative member is not less than 1×10^14 Ωcm.

In this embodiment, the electroconductive member 5 is a plate-like member of metal as the electroconductive member. However, the electroconductive member 5 is not limited to the metal plate, but it will suffice if it is an electroconductive member electrically grounded. For example, may be an electroconductive resin material (ABS, POM or the like). In this embodiment, the common electroconductive member 5 functions as the first adjacent portion A and the second adjacent portion B, but separate electroconductive members may be used for them.

The material of the first toner deposition member 6 may be porous resin material or rubber, that is, EPDM foam (having a dielectric constant of 3.1-3.4), silicone rubber foam (dielectric constant of 3.2-4.0), for example are preferable. In addition, in this embodiment, the thickness S1 of the first toner deposition member 6 is 1-3 mm.

The material of the second toner deposition member 7 may preferably be insulative polycarbonate (having a dielectric constant of 2.9-3.0), insulative polyethylene (having a dielectric constant of 2.1-2.5), *poly←pre-← (having a dielectric constant of 2.2-2.6),), PET (having a dielectric constant of 2-2.6),), PFA, FEP (having a dielectric constant of 2-2.2), or), ETFE (having a dielectric constant of 2.4-2.8). In this embodiment, the thickness S2 of the second toner deposition member 7 is larger than the thickness S1 of the first toner deposition member 6 the 1-2 mm.

In this embodiment, a distance N1 from a sensor 2 side end portion of the opening 4*a* when the shielding member 4 is in the second position to the second toner deposition member 7 as measured in the moving direction of the shielding member 4 is 4-6 mm. In addition, in this embodiment, the width N2 of the second deposition member 7 as measured in the moving direction of the shielding member 4) is 2-4 mm. The electroconductive member 5 and the first toner deposition member 6 extends away from the sensor 2 beyond an end portion of the opening 4*a* opposite from the sensor 2 at the time when the shielding member 4 takes the second position.

In this embodiment, the sensor port 2*a* of the sensor 2 is made of PC (having a dielectric constant of 3.1).

In this embodiment, the first adjacent portion A and the second adjacent portion B are directly contacted to each other, and the second adjacent portion B is directly contacted to the sensor 2. However, the present invention is not limited to such a specific structure, and another member may be provided between the first adjacent portion A and the second adjacent portion B, and under the member provided between the second adjacent portion B and the sensor 2. In addition, the widths of the first adjacent portion A and the second adjacent portion B measured in the direction substantially perpendicular to the moving direction of the shielding member 4 are preferably larger than the width of the opening 4*a* measured in the same direction, and are further preferably larger than the width of the sensor 2 (more particularly the sensor port 2*a*) measured in the same direction.

As described above, in this embodiment, the dielectric constant of the second toner deposition member 7 is smaller than the dielectric constant of the first toner deposition member 6. In addition, in this embodiment, the thickness of the second toner deposition member 7 is larger than the thickness of the first toner deposition member 6. Therefore, the electrostatic capacity of the second toner deposition member 7 (second adjacent portion B) is smaller than that of the first toner deposition member 6 (first adjacent portion A).

For this reason, from the relationship of surface potential V=amount of electric charge/electrostatic capacity, the surface potential of the second toner deposition member 7 is greater than that of the surface potential of the first toner deposition member 6. The potential after 1000 A4 size sheets are processed by the image forming apparatus 100 of this embodiment (that is, when the toner is deposited) has been measured. As a result, the surface potential of the first toner deposition member 6 is −1000-−1600V, but the surface potential of the second toner deposition member 7 is −1800--2000V. The potential is negative because the deposited toner is negatively charged. As the initial condition of the experiment, they are electrically discharged by wiping with ethanol.

Thus, in this embodiment, in the adjacent portion of the sensor 2 in which the opening 4*a* faces in the process of the movement of the shielding member 4 from the second position toward the first position, the electrostatic capacity of the second adjacent portion B closer to the sensor 2 than the first adjacent portion A is smaller than that of the first adjacent portion A. By doing so, the surface potential of the second adjacent portion B at the time when the toner is deposited can be made higher than the surface potential of the of the first adjacent portion A at the time when the toner is deposited. Therefore, when the shielding member 4 is in the second position, the movement of the toner deposited on the first adjacent portion A to the sensor 2 side beyond the second adjacent portion B is impeded, so that the contamination of the sensor 2 with the toner can be suppressed. The toner contamination of the sensor 2 has been checked by test interrupting the image forming operation, and the result is that the interval of the occurrences of the necessities of the cleaning of the sensor 2 (the number of image forming processes on the A4 size sheets) is expanded from 100-200 k sheets to 500-1000 k sheets.

In this embodiment, the material of the second toner deposition member 7 has a dielectric constant smaller than that of the first toner deposition member 6, and the thickness of the second toner deposition member 7 is larger than that of the first toner deposition member 6. However, if the electrostatic capacity of the second adjacent portion B can be made sufficiently smaller than that of the first adjacent portion A, the thickness of the second toner deposition member 7 may be equivalent to the thickness of the first toner deposition member 6 when the dielectric constant of the second toner deposition member 7 is smaller than that of the first toner deposition member 6. Or, if the electrostatic capacity of the second adjacent portion B can be made sufficiently smaller than that of the first adjacent portion A, The dielectric constants of the second toner deposition member 7 and the first toner deposition member 6 may be equivalent to each other when the thickness of the second toner deposition member 7 is larger than that of the first toner deposition member 6. Thus, when the dielectric constants are equivalent, the material of the first toner deposition member 6 and that of the second toner deposition member 7 may be the same, and the first toner deposition member 6 and the second toner deposition member 7 may be integral.

Typically, when the shielding member 4 is in the second position, only the first adjacent portion A faces the opening 4*a* as in this embodiment, but a part of the second adjacent portion B may face the opening 4*a* at this time. In addition, when the shielding member 4 is in the first position, a part of the second adjacent portion B may oppose to the opening 4*a*.

Thus, in this embodiment, the first adjacent portion A and the second adjacent portion B are provided with respective surfaces opposed to the feeding member 31 and is provided with respective toner deposition members 6, 7 of dielectric material or insulative material. In addition, in this embodiment, the first adjacent portion A and the second adjacent portion B are provided with electroconductive members 5 electrically grounded and contacted to the surfaces of the toner deposition members 6, 7 which are opposite from the surface facing the feeding member 31. The materials of the toner deposition members 6, 7 for the first adjacent portion A and the second adjacent portion B are different from each other, more particularly, the dielectric constant of the toner deposition members 6, 7 for the first adjacent portion A is larger than that for the second adjacent portion B. Furthermore, the materials of the toner deposition members 6, 7 for the first adjacent portion A and the second adjacent portion B are the same or different from each other, and the thickness of the toner deposition member 6, 7 between the surface opposing to the feeding member 31 and the opposite surface for the first adjacent portion A is smaller than that for the second adjacent portion B. When the materials of the toner deposition members 6, 7 for the first adjacent portion A and the second adjacent portion B are the same, the toner deposition members 6, 7 for the first adjacent portion A and the second adjacent portion B may be integral with each other.

As described in the foregoing, according to this embodiment, even when the toner having entered through the opening 4*a* of the shielding member 4 is deposited on the member in the-neighborhood of the sensor 4, the movement of such toner toward the sensor 2 can be impeded. Therefore, according to this embodiment, the shielding member 4 having a simple structure is effective to suppress the contamination of the sensor 2 for detecting the controlling images. Therefore, the intervals of the cleaning operations for cleaning the sensor 2 while interrupting the image forming operation can be increased.

[Embodiment 2]

Embodiments 2 will be described. The fundamental structures and the operations of the image forming apparatus of this embodiment are the same as those of Embodiment 1 described above. In the description of this embodiment, the same reference numerals as in Embodiment 1 are assigned to the elements having the corresponding functions in this embodiment, and the detailed description thereof is omitted for simplicity.

Figure 9:
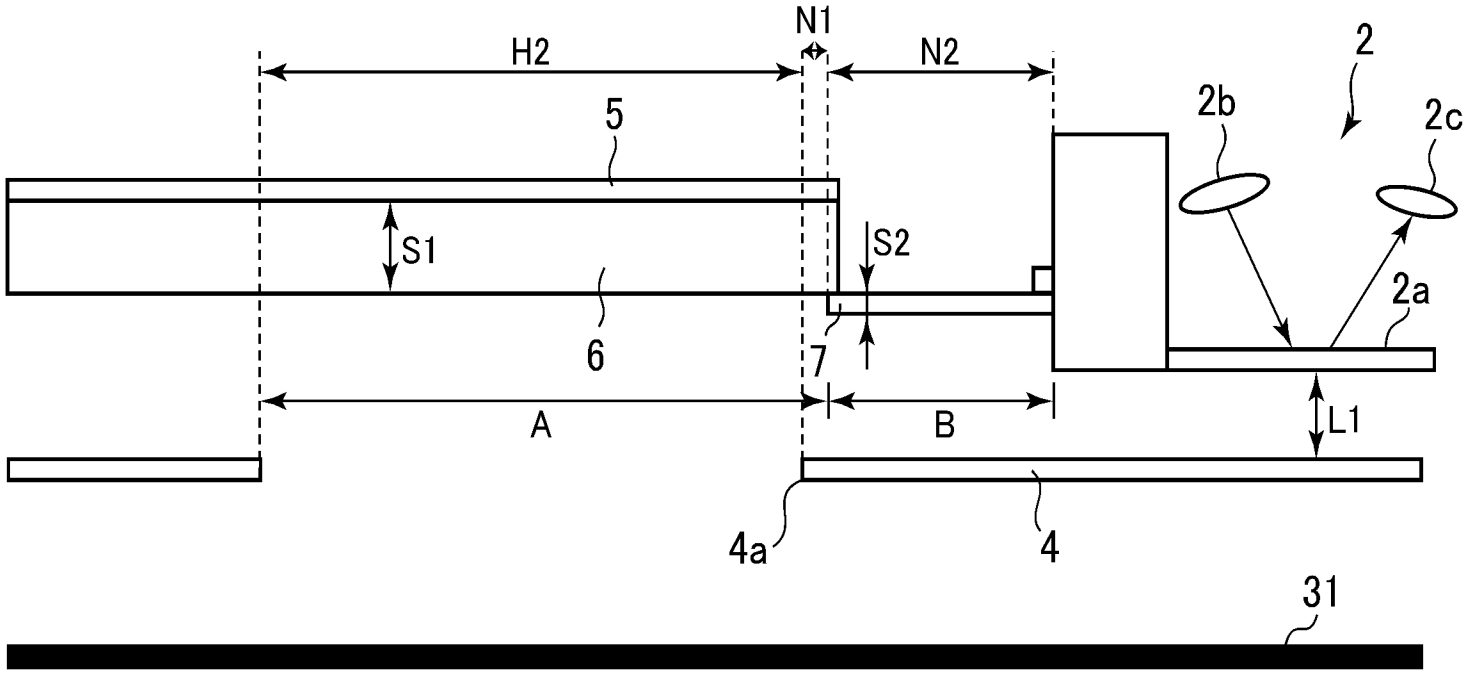
FIG. 9 is a schematic section of view illustrating a structure adjacent to the sensor in Embodiment 2 of the present invention.

FIG. 9 is a schematic sectional side view illustrating the details of the neighborhood of the sensor 2 in this embodiment. In this embodiment, the parts adjacent to the sensor 2 faced to the opening 4*a* in the process of the movement of the shielding member 4 from the second position toward the first position have the following structures. The member adjacent to the sensor 2 comprises an electroconductive member 5 of electroconductive material electrically grounded, and a first toner deposition member 6 and a second toner deposition member 7 of a dielectric material or an insulative material. The first toner deposition member 6 is placed in an upstream side, and the second toner deposition member 7 is placed in the downstream side with respect to the moving direction of the shielding member 4 from the second position toward the first position. The electroconductive member 5 is contacted to the surface opposite from the toner deposition surface of the first toner deposition member 6. The first adjacent portion A is constituted by the electroconductive member 5 and the first toner deposition member 6, and the second adjacent portion B is constituted by the second toner deposition member 7.

The material of the first toner deposition member 6 may preferably be the same as those of the first toner deposition member 6 in Embodiment 1. In addition, in this embodiment, the thickness S1 of the first toner deposition member 6 is 1-3 mm.

The material of the second toner deposition member 7 may preferably be the same as those of the second toner deposition member 7 in Embodiment 1. In addition, in this embodiment, the thickness S2 of the second toner deposition member 7 as 0.1-1 mm.

In this embodiment, the electroconductive member 5 is provided in contact with the surface of the first toner deposition member 6 opposite from the toner deposition surface, but no electroconductive member 5 is provided on the surface opposite from the toner deposition surface of the second toner deposition member 7. That is, in this embodiment, the surface of the second toner deposition member 7 opposite from the surface opposing the intermediary transfer belt 31 is not contacted by an electrically grounded electroconductive member. In this embodiment, the electroconductive member 5 is made of metal plate, similarly to Embodiment 1.

In this embodiment, a distance N1 from a sensor 2 side end portion of the opening 4*a* when the shielding member 4 is in the second position to the second toner deposition member 7 as measured in the moving direction of the shielding member 4 is 0.5-1 mm. In addition, in this embodiment, the width N2 of the second deposition member 7 as measured in the moving direction of the shielding member 4) is 3-6 mm. The electroconductive member 5 and the first toner deposition member 6 extends away from the sensor 2 beyond an end portion of the opening 4*a* opposite from the sensor 2 at the time when the shielding member 4 takes the second position.

In addition, in this embodiment, the first adjacent portion A and the second adjacent portion B are directly contacted to each other, and the second toner deposition member 7 is contacted to the first toner deposition member 6. Furthermore, in this embodiment a member is provided between the second adjacent portion B and the sensor 2.

In this embodiment, the reference potential as seen from the toner deposition surface of the first toner deposition member 6 is provided by the electrically grounded electroconductive member 5 disposed in contact with the surface of the surface opposite from the toner deposition surface. On the other hand, the reference potential as seen from the toner deposition surface of the second toner deposition member 7 is theoretically infinity, and the part from the reference potential to the toner deposition surface is completely occupied by the second toner deposition member 7 having the dielectric constant smaller than that of the first toner deposition member 7 and by the air layer. Therefore, the electrostatic capacity from the toner deposition surface of the second toner deposition member 7 to the reference potential is smaller than the electrostatic capacity from the toner deposition surface of the first toner deposition member 6 to the reference potential.

Therefore, similarly to Embodiments 1, from surface potential V=amount of electric charge/electrostatic capacity, the surface potential of the second toner deposition member 7 is higher than the surface potential of the of the first toner deposition member 6. The potential after 1000 A4 size sheets are processed by the image forming apparatus 100 of this embodiment (that is, when the toner is deposited) has been measured. As a result, the surface potential of the first toner deposition member 6 is −1000--1600V, but the surface potential of the second toner deposition member 7 is −1800--2100V. The potential is negative because the deposited toner is negatively charged. As the initial condition of the experiment, they are electrically discharged by wiping with ethanol.

Therefore, with the structure of this embodiment, similarly to Embodiments 1, the second adjacent portion B is effective to impede the movement of the toner, and the contamination of the sensor 2 with the toner can be suppressed. The contamination of the sensor 2 in this embodiment has been checked by test interrupting the image forming operation, and the result is that the interval of the occurrences of the necessities of the cleaning of the sensor 2 (the number of image forming processes on the A4 size sheets) is expanded from 100-200 k sheets to 500-1000 k sheets.

Thus, according to this embodiment, the first adjacent portion A includes the toner deposition member 6 of dielectric member or insulative member opposed to the feeding member 31. In addition, in this embodiment, the first adjacent portion A includes the electroconductive member 5 of electrically grounded electroconductive member contacted to the surface of the toner deposition member 6 opposite from the surface opposing the feeding member 31. On the other hand, in this embodiment, the second adjacent portion B includes the toner deposition member 7 of dielectric member or insulative member and being in the surface opposing the feeding member 31. In this embodiment, in the second adjacent portion B, no electrically grounded electroconductive member is contacted to the surface opposite to the surface opposing the feeding member 31. In addition, in this embodiment, the materials of the first adjacent portion A and the second adjacent portion B are different from each other, and the dielectric constants of the first adjacent portion A is larger than that of the second adjacent portion B.

According to this embodiment, the advantageous effects similar to those of the first embodiment are provided, with a simple structure of the sensor unit 1.

[Embodiment 3]

Embodiments 3 will be described. The fundamental structures and the operations of the image forming apparatus of this embodiment are the same as those of Embodiment 1 described above. In the description of this embodiment, the same reference numerals as in Embodiment 1 are assigned to the elements having the corresponding functions in this embodiment, and the detailed description thereof is omitted for simplicity.

Figure 10:
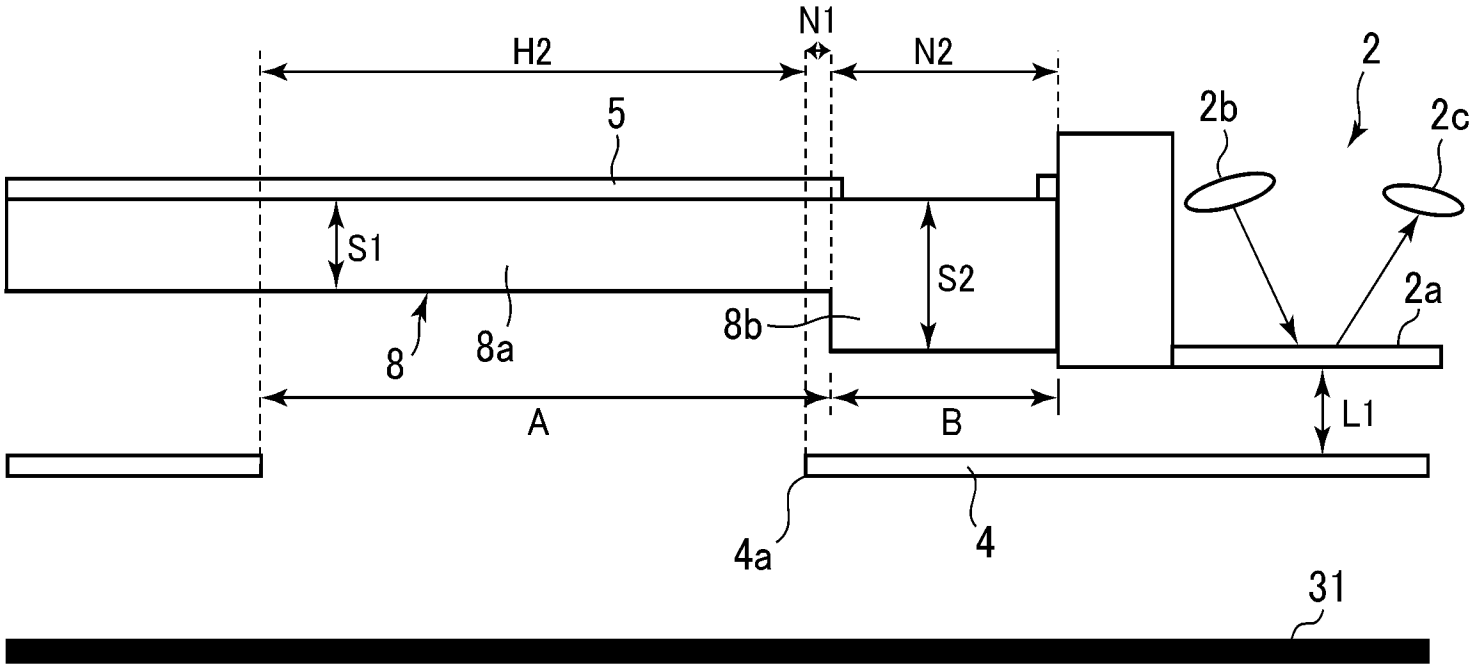
FIG. 10 is a schematic section of view illustrating a structure adjacent to the sensor in Embodiment 1 of the present invention.

FIG. 10 is a schematic sectional side view illustrating the details of the neighborhood of the sensor 2 in this embodiment. In this embodiment, the parts adjacent to the sensor 2 faced to the opening 4*a* in the process of the movement of the shielding member 4 from the second position toward the first position are constituted as follows. The member in the-neighborhood of the sensor 2 includes an electroconductive member 5 of electrically grounded electroconductive member, a toner deposition member 8 provided with a first portion 8*a* and a second portion 8*b* of dielectric member or insulative member which have different thicknesses. The first portion 8*a* is disposed in an upstream side, and the second portion 8*b* is disposed in the downstream side with respect to the moving direction of the shielding member 4 from the second position to the first position. The electroconductive member 5 is contacted to the surface of the first portion 8*a* of the toner deposition member 8 opposite to the toner deposition surface. The first adjacent portion A is constituted by the electroconductive member 5 and the first portion 8*a* of the toner deposition member 8, and the second adjacent portion B is constituted by the second portion 8*b* of the toner deposition member 8.

As for the material of the toner deposition member 8, those of described in the first embodiment for the first toner deposition member 6 or those described for the second toner deposition member 7 are usable. The thickness S1 of the first portion 8*a* of the toner deposition member 8 is 1-3 mm, and the thickness S2 of the second portion 8*b* of the toner deposition member 8 is 4-5 mm.

In this embodiment, the electroconductive member 5 is contacted to the surface of the first portion 8*a* of the toner deposition member 8 opposite to the toner deposition surface, but no electroconductive member 5 is provided on the surface of the second portion 8*b* of the toner deposition member 8. That is, in this embodiment, no electrically grounded electroconductive member is contacted to the surface of the second portion 8*b* of the toner deposition member 8 opposite from the surface opposing to the intermediary transfer belt 31. In this embodiment, the electroconductive member 5 is made of metal plate, similarly to Embodiment 1.

The distance N1 from the sensor 2 side end portion of the opening 4*a* to the second portion 8*b* of the toner deposition member 8 as measured in the moving direction of the shielding member 4 at the time when the shielding member 4 takes the second position is 0.5-1 mm. In this embodiment, the width N2 of the second portion 8*b* of the toner deposition member 8 as measured in the moving direction of the shielding member 4 is 3-6 mm. The electroconductive member 5 and the first portion 8*a* of the toner deposition member 8 extends away from the sensor 2 beyond the end portion of the opening 4*a* remote from the sensor 2.

In this embodiment, toner deposition member 8 at the first adjacent portion A and the second adjacent portion B is integral, and the first adjacent portion A and the second adjacent portion are directly contacted to each other, and another member is interposed between the second adjacent portion B and the sensor 2.

In this embodiment, the reference potential as seen from the toner deposition surface of the first portion 8*a* of the toner deposition member 8 is provided by the electrically grounded electroconductive member 5 provided contacted to the surface opposite from the toner deposition surface of the first portion 8*a*. On the other hand, the reference potential as seen from the toner deposition surface of the second portion 8*b* is theoretically infinity, and the part from the reference potential to the toner deposition surface is completely occupied by the first portion 8*a*, the second portion 8*b* having the same dielectric constant and the air layer having the dielectric constant smaller than that of the first portion 8*a*. Therefore, the electrostatic capacity from the toner deposition surface of the second portion 8*b* of the toner deposition member 8 to the reference potential is smaller than the electrostatic capacity from the toner deposition surface of the first portion 8*a* of the toner deposition member 8 to the reference potential Therefore, similarly to Embodiments 1, from surface potential V=amount of electric charge/electrostatic capacity, the surface potential of the second portion 8*b* of the toner deposition member 8 is higher than the surface potential of the first portion 8*a* of the toner deposition member 8. The potential after 1000 A4 size sheets are processed by the image forming apparatus 100 of this embodiment (that is, when the toner is deposited) has been measured. As a result, the surface potential of the first portion 8*a* of the toner deposition member 8 as −1000-−1600V, the surface potential of the second portion 8*b* of the toner deposition member 8 is −1800-−2100V. The potential is negative because the deposited toner is negatively charged. As the initial condition of the experiment, they are electrically discharged by wiping with ethanol.

Therefore, with the structure of this embodiment, similarly to Embodiments 1, the second adjacent portion B is effective to impede the movement of the toner, and the contamination of the sensor 2 with the toner can be suppressed. The contamination of the sensor 2 in this embodiment has been checked by test interrupting the image forming operation, and the result is that the interval of the occurrences of the necessities of the cleaning of the sensor 2 (the number of image forming processes on the A4 size sheets) is expanded from 100-200 k sheets to 500-1000 k sheets.

In this embodiment, the toner deposition member of the first adjacent portion A and the second adjacent portion B is integral when the materials of the first adjacent portion A and the second adjacent portion B of the toner deposition member are the same, but the first adjacent portion A and the second adjacent portion B may be separate members.

According to this embodiment, the advantageous effects similar to those of the first embodiment are provided, with a simple structure of the sensor unit 1.

[Others]

The present invention is not limited to the above-described embodiments.

For example, in the foregoing embodiments, the sensor unit comprises a plurality of sensors, and the structures of the portions to which the openings of the shielding member oppose are substantially the same, but the present invention is not limited to such a structure. The sensor unit may include a single sensor. In the case of the plurality of sensors employed, the structure of the part to which the opening of the shielding member is opposed may be one of those described in the foregoing embodiments, for at least one of the sensors.

In the foregoing embodiments, the sensor unit detects the controlling image carried on the intermediary transfer member as the feeding member, but the present invention is not limited to such a structure. The sensor unit may detect the controlling image carried on the recording material carrying member as the feeding member. The recording material carrying member may be an endless belt similarly to the intermediary transfer belt in the foregoing embodiments. In addition, the sensor unit may detect the controlling image carried on a photosensitive member and/or dielectric member for electrostatic recording as the feeding member.

In the foregoing embodiments, the sensor unit detects the image density control patch, the toner supply control patch and the color misregistration correction control patch, and at least one of them are another controlling image may be detected by the sensor unit.

Furthermore, the intermediary transfer member or the recording material carrying member is not limited to the endless belt, but it may be in the form of a drum including a frame and a film (sheet) stretched therearound. Moreover, the photosensitive member is not limited to the drum type, but may be an endless belt.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2015-112706 filed on Jun. 2, 2015, which is hereby incorporated by reference herein in its entirety.

What is claimed is:

1. An image forming apparatus, comprising:

a movable image bearing member;

an image forming unit configured to form a test toner image on said image bearing member;

a sensor provided opposed to said image bearing member and including a detecting portion configured to detect the test toner image formed on said image bearing member;

a changing portion configured to change an image forming condition of said image forming unit on the basis of a detection result of said detecting portion;

a shielding member having an opening and provided between said detecting portion and said image bearing member, said shielding member being reciprocable between a first position and a second position, wherein when said shielding member is in the first position, said detecting portion is exposed to said image bearing member at a position where said opening is opposed to said detecting portion, and when said shielding member is in the second position, said shielding member shields said detecting portion from said image bearing member;

a first opposing portion includes a first member of porous resin material or rubber disposed opposed to said image bearing member and provided at a position opposing said image bearing member through said opening in a process of movement of said shielding member from the second position to the first position;

an electrically grounded electroconductive member disposed on a side opposite a side of said first member opposed to said image bearing member; and a second opposing portion includes a second member of a dielectric material or insulative material disposed opposed to said image bearing member and provided at a position opposing said image bearing member through said opening in the process of movement of said shielding member from the second position to the first position;

wherein said second opposing portion is disposed at a position closer to said sensor than said first opposing portion, and said second opposing portion has an electrostatic capacity smaller than that of said first opposing portion.

2. An apparatus according to claim 1, wherein materials of said first member and said second member are different from each other, and said first member and said second member are disposed adjacent to each other.

3. An apparatus according to claim 1, wherein a thickness of said first member is smaller than a thickness of said second member.

4. An apparatus according to claim 3, wherein the materials of said first member and said second member are the same, and said first member and said second member are integral with each other.

5. An apparatus according to claim 1, wherein the electrically grounded electroconductive member is disposed on a side opposite a side of said second member opposed to said image bearing member.

6. An apparatus according to claim 1, wherein said first member has a dielectric constant larger than that of said second member.

7. An apparatus according to claim 1, wherein said sensor is contained in a box-like casing partly constituted by said shielding member, said apparatus further comprising an air feeding device configured to provide an inside pressure of said casing which is higher than an outside pressure of said casing.

8. An apparatus according to claim 1, wherein said first member is EPDM foam having a dielectric constant of 3.1-3.4 or silicone rubber foam having a dielectric constant of 3.2-4.0.

9. An apparatus according to claim 1, wherein said second opposing portion is disposed at a position closer to said image bearing member than said first opposing portion.

* * * * *